United States Patent [19]

Tolli

[11] Patent Number: 4,807,788

[45] Date of Patent: Feb. 28, 1989

[54] THUMB HOLSTER

[76] Inventor: Frederick J. Tolli, 335 N. Higbee, Idaho Falls, Id. 83401

[21] Appl. No.: 9,717

[22] Filed: Feb. 2, 1987

[51] Int. Cl.[4] ..... A45F 5/00; A01K 97/04; B65D 25/52

[52] U.S. Cl. ..... 224/197; 224/252; 224/269; 224/904

[58] Field of Search ..... 224/232, 269, 251, 252, 224/197, 904; 211/13

[56] References Cited

U.S. PATENT DOCUMENTS 28,175 5/1860 Hoffman ..... 224/232

4,299,345 10/1981 Lanzl ..... 224/252

*Primary Examiner*—Henry J. Recla

[57] ABSTRACT

A thumb holster for resting and holding the digit(s) of the hand, which attaches to the user's apparel.

1 Claim, 1 Drawing Sheet

THUMB HOLSTER

SUMMARY OF THE INVENTION

The thumb holster is intended as a holder and rest for the thumb and/or finger(s) of the hand. It is not intended to hold a weapon, and is smaller than a firearm holster. It is essentially comprised of a main body, which holds the digit(s); and an attaching device, for example, but not limited to; a clip-like device; or hook. Said main body which is open at both ends, is fastened to said attaching device between the open ends by a fastener which allows said main body to completely rotate, therefore user can wear it on either side of the body, and said main body will conform to the angle of the hand. Said main body is lined for comfort. Said attaching device attaches to user's apparel.

Details of the invention are provided in the following descriptions, claims, and drawings.

DETAILED DESCRIPTION OF THE ILLUSTRATED EMBODIMENTS

Figure 1:
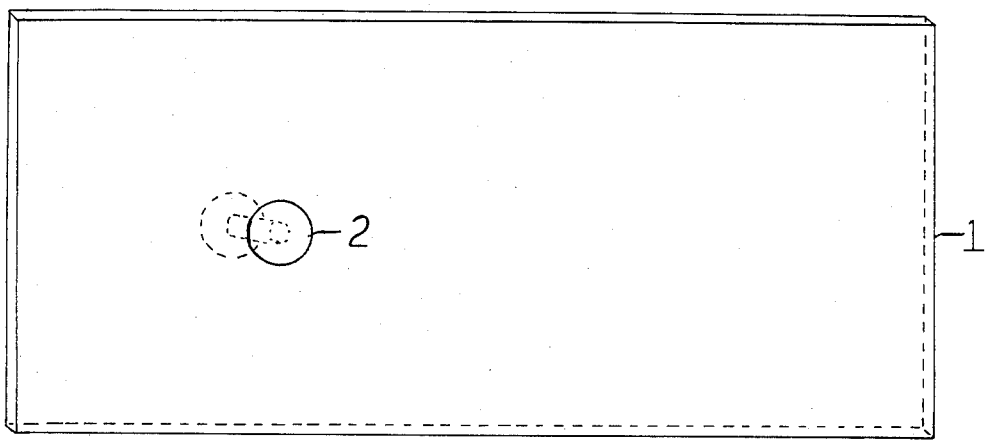
FIG. 1 is a see-thru view of the main body before folding, and fastener.
Figure 2:
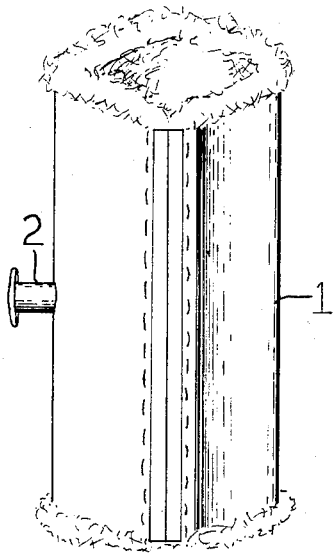
FIG. 2 is a stitched end view of main body with fastener.
Figure 3:
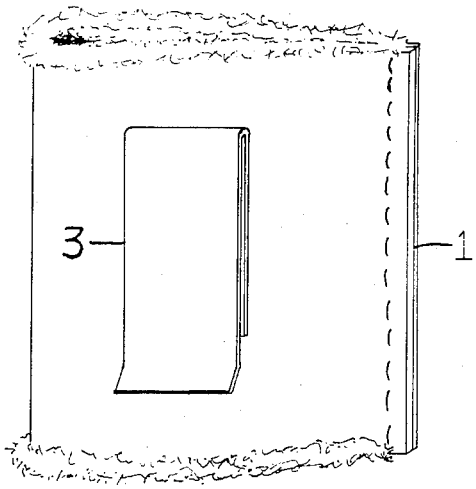
FIG. 3 is a side view of main body with clip.
Figure 4:
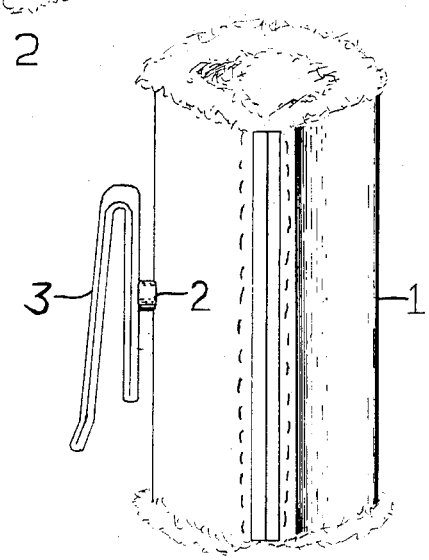
FIG. 4 is a stitched end view of main body and clip attached with fastener.

FIG. 1 shows the inside of the unfolded main body (1) and an attached rivet-type fastener (2). FIG. 2 is a view of the stitched end of the main body (1) after being lined with fur, folded and stitched. It may be lined with fur for comfort, and is open at both ends. The fastener (2) allows the main body (1) to swivel completely around. FIG. 3 is a fastener side view of the main body (1) with clip attached (3). The clip (3) hooks on the user's apparel, such as, but not exclusively: Pants pocket; belt; belt loop; waistline. FIG. 4 is a view of the stitched end of the main body (1) attached with a fastener (2) to the clip (3).

These descriptions and drawings are merely exemplary and not limiting, as other embodiments may be practiced within the spirit and scope of the following claims.

I claim:

1. A thumb holster for holding the thumb and/or finger(s) of the user's hand comprising:

a hollow tube-like main body defined by a sidewall having inner and outer surfaces and a passage therethrough open at both ends and sized to receive the thumb and/or finger(s) of a user's hand, said inner surface being lined with a soft material confortable to the thumb and/or finger(s) of the user's hand, attaching means for attaching said main body to a user'belt, a fastener mounted to said outer surface of said main body so as to intersect said passage, said attaching means rotatably mounted to said fastener whereby said attaching means is allowed to completely rotate with respect to said main body.

* * * * *